US010706762B2

(12) United States Patent
Jung et al.

(10) Patent No.: US 10,706,762 B2
(45) Date of Patent: Jul. 7, 2020

(54) DISPLAY DEVICE AND CONTROL METHOD FOR COLOR GAMUT RANGE VARIATION AND DRIVING CURRENT ADJUSTMENT

(71) Applicant: Samsung Electronics Co., Ltd., Suwon-si, Gyeonggi-do (KR)

(72) Inventors: Ho-young Jung, Seoul (KR); Jee-young Yeom, Yongin-si (KR); Min-woo Lee, Hwaseong-si (KR); Won-hee Choe, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/092,950

(22) PCT Filed: Apr. 17, 2017

(86) PCT No.: PCT/KR2017/004099
§ 371 (c)(1),
(2) Date: Oct. 11, 2018

(87) PCT Pub. No.: WO2017/179959
PCT Pub. Date: Oct. 19, 2017

(65) Prior Publication Data

US 2019/0130817 A1 May 2, 2019

(30) Foreign Application Priority Data

Apr. 15, 2016 (KR) ..... 10-2016-0046268

(51) Int. Cl.
*G09G 3/20* (2006.01)
*G09G 3/32* (2016.01)
(Continued)

(52) U.S. Cl.
CPC ..... *G09G 3/2003* (2013.01); *G09G 3/32* (2013.01); *G09G 5/02* (2013.01); *G09G 5/026* (2013.01);
(Continued)

(58) Field of Classification Search
CPC ..... G09G 3/32; G09G 3/2003; G09G 3/3406; G09G 3/3413; G09G 3/3208;
(Continued)

(56) References Cited

U.S. PATENT DOCUMENTS 7,365,720 B2 4/2008 Bouwens et al.
8,223,180 B2 * 7/2012 Elliott ..... G09G 3/3406 345/214
(Continued)

FOREIGN PATENT DOCUMENTS

JP 2015-142276 A 8/2015
JP 2015-179253 A 10/2015
(Continued)

*Primary Examiner* — Darlene M Ritchie
(74) *Attorney, Agent, or Firm* — Jefferson IP Law, LLP

(57) ABSTRACT

A display device is disclosed. The present display device comprises: a display unit of which the color gamut range varies according to the size of a driving current; and a processor for analyzing, per frame unit, the color distribution of an image signal, and adjusting, per frame unit, the size of the driving current on the basis of the analyzed color distribution such that the display unit operates within the color gamut range.

15 Claims, 10 Drawing Sheets

(51) Int. Cl.
*G09G 5/02* (2006.01)
*G09G 5/10* (2006.01)

(52) U.S. Cl.
CPC ..... *G09G 5/10* (2013.01); *G09G 2320/0242* (2013.01); *G09G 2320/0606* (2013.01); *G09G 2320/0613* (2013.01); *G09G 2320/0626* (2013.01); *G09G 2320/0633* (2013.01); *G09G 2320/0666* (2013.01); *G09G 2354/00* (2013.01); *G09G 2360/16* (2013.01)

(58) Field of Classification Search
CPC ..... G09G 3/3225; G09G 3/3233; G09G 5/02; G09G 5/10; G09G 5/026; G09G 5/06; G09G 2320/0242; G09G 2320/0633; G09G 2320/0613; G09G 2320/0626; G09G 2320/0666; G09G 2320/0606; G09G 2320/066; G09G 2360/16; G09G 2354/00; H04N 1/60; H04N 1/6002; H04N 1/6005; H04N 1/6008; H04N 9/04513
See application file for complete search history.

(56) References Cited

U.S. PATENT DOCUMENTS

| | | | | |
|---|---|---|---|---|
| 8,379,038 | B2 | 2/2013 | Shin et al. | |
| 9,607,555 | B2 | 3/2017 | Kimura | |
| 9,773,458 | B2 | 9/2017 | Sugimoto | |
| 2004/0119721 | A1* | 6/2004 | Kim | H04N 9/643 345/600 |
| 2005/0174309 | A1 | 8/2005 | Bouwens et al. | |
| 2006/0285136 | A1 | 12/2006 | Shin et al. | |
| 2007/0139437 | A1 | 6/2007 | Boroson et al. | |
| 2007/0223810 | A1* | 9/2007 | Sekine | H04N 1/46 382/162 |
| 2009/0058876 | A1* | 3/2009 | Wang | G09G 3/3413 345/590 |
| 2013/0169662 | A1 | 7/2013 | Yun et al. | |
| 2013/0335388 | A1* | 12/2013 | Yun | G09G 5/02 345/207 |
| 2013/0335439 | A1 | 12/2013 | Jeong et al. | |
| 2015/0109356 | A1* | 4/2015 | Yata | G09G 3/2003 345/691 |
| 2015/0154920 | A1* | 6/2015 | Buckley | G09G 3/3413 345/690 |
| 2015/0213766 | A1 | 7/2015 | Sugimoto | |
| 2015/0243228 | A1 | 8/2015 | Kimura | |
| 2016/0335957 | A1* | 11/2016 | Fu | G09G 3/3426 |
| 2017/0069293 | A1* | 3/2017 | Christmann | G09G 3/20 |
| 2017/0169751 | A1* | 6/2017 | Ando | G09G 3/2003 |
| 2017/0301275 | A1* | 10/2017 | Wang | G09G 3/2092 |
| 2018/0096466 | A1* | 4/2018 | Eto | G06T 5/00 |

FOREIGN PATENT DOCUMENTS

| | | | |
|---|---|---|---|
| JP | 2015-201789 | A | 11/2015 |
| JP | 2015-210331 | A | 11/2015 |
| KR | 10-2005-0065356 | A | 6/2005 |
| KR | 10-1133572 | B1 | 4/2012 |
| KR | 10-2013-0076132 | A | 7/2013 |
| KR | 10-2013-0141920 | A | 12/2013 |
| KR | 10-2015-0000673 | A | 1/2015 |

* cited by examiner

DISPLAY DEVICE AND CONTROL METHOD FOR COLOR GAMUT RANGE VARIATION AND DRIVING CURRENT ADJUSTMENT

TECHNICAL FIELD

The present disclosure relates to a display device and a control method thereof, and more particularly, to a display device and a control method thereof that can adjust a gamut range of a display unit by adjusting a driving current applied to the display unit.

BACKGROUND ART

A display device is a device for processing and displaying digital or analog image signals received from the outside or various image signals stored in compressed files of various formats in an internal storage device.

Recent display devices can receive image signals from various devices, and can display received image signals. However, the conventional display device displays an input image signal only within the default gamut range set in the display device.

More specifically, the conventional display device displays the input image signal within the default gamut range even when the input image signal has a gamut range that is greater than the default gamut range. For example, although an image signal having a gamut greater than a broadcast signal is input and the display device can support the gamut of the input image signal, the image signal received within the gamut range set by default is displayed. Accordingly, there is a need for a technique of changing the gamut range of a display device in order to more accurately express the color of an input image signal.

DETAILED DESCRIPTION

Tasks to Be Solved

The present disclosure pertains to a display device which is capable of adjusting a gamut range of a display unit by adjusting a driving current that is applied to a display unit and a controlling method thereof.

Means for Solving Problems

A display device according to an exemplary embodiment includes a display unit of which a gamut range is changed according to a size of a driving current; and a processor configured to analyze color distribution by frame units of an image signal, and adjust a size of the driving current by frame units so that the display operates with a gamut range based on the analyzed color distribution.

The processor may determine a gamut range of the image signal based on a type of the image signal, determine a gamut range of the display unit based on the determined gamut range of the image signal, and adjust the determined gamut range of the display unit by frame units based on the analyzed color distribution.

The processor may divide a vicinity of the determined gamut range of the image signal into a plurality of regions, and if a ratio of a number of pixels included in at least one of the plurality of regions to an entire number of pixels of the frame is greater than or equal to a predetermined value, adjust the determined gamut range of the display unit to a direction of at least one region.

The display device further includes a storage unit configured to store information on sizes of a plurality of driving currents and information on a plurality of gamut ranges respectively corresponding to sizes of the plurality of driving currents, and the processor may determine a gamut range of which an area overlapping with a gamut range of the image signal is largest, from among a plurality of gamut ranges stored in the storage, as a gamut range of the display unit.

The display device may further include an input unit configured to receive a target gamut range by a user, and the processor may determine the target gamut range received from the user as a gamut range of the image signal.

The processor may, if there is a region in which a gamut range of the image signal is not included in the adjusted gamut range of the display unit, control the display unit so that a color of the not included region is displayed to be a color at a point in which a virtual line connected to a triple point of a gamut of the image signal intersects with a boundary of the adjusted gamut range of the display unit.

[12]

The display unit may display the image signal with a gamut range which is adjusted by the frame units.

The display may adjust a size of driving current by pixels of the display unit.

The processor may adjust application time of the driving current based on a target luminance and the adjusted size of driving current by the frame units.

The display unit may include a display panel composed of LEDs.

According to an exemplary embodiment, a controlling method of a display device includes analyzing color distribution by frame units of an image signal; and adjusting a size of the driving current by frame units so that the display operates with a gamut range based on the analyzed color distribution.

The method may further include determining a gamut range of the image signal based on a type of the image signal; determining a gamut range of the display unit based on the determined gamut range of the image signal; and adjusting the determined gamut range of the display unit by frame units based on the analyzed color distribution.

The adjusting may include dividing a vicinity of the determined gamut range of the image signal into a plurality of regions; and if a ratio of a number of pixels included in at least one of the plurality of regions to an entire number of pixels of the frame is greater than or equal to a predetermined value, adjusting the determined gamut range of the display unit to a direction of at least one region.

The method further includes storing information on sizes of a plurality of driving currents and information on a plurality of gamut ranges respectively corresponding to sizes of the plurality of driving currents, and the determining includes determining a gamut range of which an area overlapping with a gamut range of the image signal is largest, from among a plurality of gamut ranges stored in the storage, as a gamut range of the display unit.

The method further includes receiving a target gamut range by a user, and the determining may include determining the target gamut range received from the user as a gamut range of the image signal.

if there is a region in which a gamut range of the image signal is not included in the adjusted gamut range of the display unit, the method may include displaying a color of the not included region to be a color at a point in which a virtual line connected to a triple point of a gamut of the image signal intersects with a boundary of the adjusted gamut range of the display unit.

The method may further include displaying the image signal with a gamut range which is adjusted by the frame units.

The adjusting may include adjusting a size of driving current by pixels of the display unit.

The adjusting may include, based on a target luminance and the adjusted size of driving current, adjusting application time of the driving current.

The display unit may include a display panel composed of LEDs.

BEST MODE OF INVENTION

Figure 1:
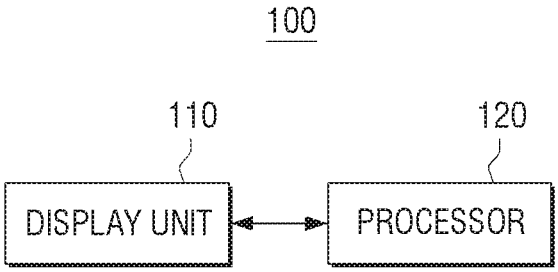
FIG. 1 is a block diagram illustrating a brief configuration of a display device according to an exemplary embodiment.

Hereinafter, the present disclosure will be described in detail with reference to the drawings. In the following description of the present disclosure, detailed description of known functions and configurations incorporated herein will be omitted when it may make the subject matter of the present invention rather unclear. In addition, the following embodiments can be modified into various other forms, and the scope of the technical idea of the present disclosure is not limited to the following examples. Rather, these embodiments are provided so that this disclosure will be more thorough and complete, and will fully convey the scope of the present disclosure to those skilled in the art Also, "comprising" means that other components may be included, rather than excluding other components, unless specifically stated otherwise. Further, various elements and regions in the drawings are schematically drawn. Accordingly, the spirit of the present disclosure is not limited by the relative size or spacing depicted in the accompanying drawings.

FIG. 1 is a block diagram illustrating a brief configuration of a display device according to an exemplary embodiment.

Referring to FIG. 1, the display device 100 according to the exemplary embodiment includes the display unit 110 and the processor 120.

The display unit 110 displays an image signal. Specifically, the display unit 110 may directly display an image signal received from an external device or an image signal stored in the display device 100, or may display an image signal in a gamut range adjusted by a processor 120 to be described later. For example, the processor 120 may display an image signal in a gamut range adjusted on a frame-by-frame basis.

The display unit 110 may display various types of information provided by the display device 100. Specifically, the display unit 110 may display a gamut range of an image signal and a gamut range set in the display device 100, and may display a user interface window to set a gamut range to be applied to the image signal.

Meanwhile, the gamut range of the display unit 110 can be varied according to a size of the applied driving current. The display unit 110 may include a display panel composed of LEDs.

In this case, a light emitting diode (LED) is a semiconductor device which emits light by flowing a current to a compound such as gallium arsenide, injects minority carriers (electrons or holes) by using the p-n junction of m semiconductors, emits light by recombination, emits red, green, yellow and blue light when current is applied. Accordingly, the range of the color gamut that can be represented by adjusting the size of the driving current applied to the display unit 110 can be adjusted.

At this time, the luminance of the display unit 110 changes according to the size of the driving current applied to the display unit 110, and the luminance of the display unit 110 can be adjusted by adjusting the driving time of the current. The details of this will be described in detail with reference to FIG. 5.

The processor 120 determines a color gamut range of the image signal. Specifically, the processor 120 may determine a color gamut range of the image signal based on the type of the image signal. For example, when the device providing the image signal is changed, the processor 120 may determine the gamut range of the input image signal based on the format name of the image signal, the color standard information of the image signal (for example, sRGB standard information). Specifically, when the input image signal is a broadcast signal format, the standard gamut of the broadcast signal is the sRGB gamut, and the processor 120 can determine that the gamut of the input image signal is in the sRGB gamut range.

In addition, the processor 120 may determine the gamut range based on the device information of the device providing the image signal. Here, the device information may be information on the device category (e.g., set-top box, DVD player, etc.) of the device and gamut range information of the image signal output from the device. For example, when it is determined that the device providing the image signal is a set-top box, the set-top box is a device for providing a broadcast signal format, and the standard gamut of a broadcast signal is an sRGB gamut. Accordingly, the processor 120 may determine that the gamut range of the input image signal is in the sRGB gamut range. Meanwhile, in the above description, it was described that the standard gamut is sRGB, but in actual implementation, the processor 120 may determine that the gamut of the image signal is in the gamut range such as DCI-P3, adobe RGB, and Rec.709.

The processor 120 may determine the gamut range (or gamut range of the display device 100) of the display unit 110 based on the determined gamut of the image signal. Specifically, the processor 120 may determine the gamut range of which the overlapping area with the gamut range of the determined image signal is widest, from among a plurality of gamut ranges corresponding to the size of the plurality of driving currents that can be applied to the display unit 110, as the gamut range of the display unit 110. At this time, the processor 120 may drive the display unit 110 with a driving current having a size corresponding to the determined gamut range out of the sizes of the plurality of driving currents stored in the storage unit 130 and a plurality of gamut ranges corresponding thereto.

Meanwhile, the processor 120 may adjust the gamut range of the display unit 110 determined by analyzing the color distribution of the image signal. Here, the processor 120 may analyze the color distribution in units of frames of the image signal and adjust the gamut range in units of frames. Specifically, the processor 120 divides the vicinity of the boundary of the gamut range of the determined image signal into a plurality of regions, and if the ratio of the number of pixels included in at least one of the plurality of regions to the total number of pixels is equal to or greater than a predetermined value, the gamut range of the display unit 110 can be extended in the direction of the area where the ratio is equal to or greater than a predetermined value. As described above, by adjusting the gamut range of the display unit 110 on a frame-by-frame basis, a deeper color expression is available. The method of adjusting the gamut range of the display unit 110 according to the color analysis of the image signal will be described in detail with reference to FIGS. 6 and 7.

In the above description, it has been described that the range of the gamut of the display unit 110 is adjusted according to the color analysis of the image signal. However, in actual implementation, the gamut range of the determined image signal can be adjusted.

Meanwhile, the processor 120 may adjust the size of the driving current for each pixel of the display unit 110. Thus, the processor 120 can adjust the gamut range of the display unit 110 in units of pixels. As described above, by adjusting the gamut range of the display unit 110 in units of pixels, the representable colors can be more diversified and the image signal can be displayed more accurately. Adjusting the gamut range of the display unit 110 in units of pixels will be described in detail with reference to FIG. 8.

Meanwhile, the processor 120 may, if there is an area in which the gamut range of the image signal is not included in the adjusted gamut range of the display unit 110, adjust the not included gamut range. Specifically, the display unit 110 can be controlled so that the color of the of the region not included in the gamut range of the display unit 110 is displayed as the color at the point at which a virtual line which connects the color point not included in the gamut range with a triple point (that is, white light region) of the gamut range of the image signal, intersects with the boundary of the gamut range of the adjusted display unit 110. However, the present disclosure is not limited thereto, and the processor 120 may correct the color of an image signal and display it using a general gamut correction method.

The processor 120 may control the display unit 110 to display the image signal in the gamut range of the display unit 110 when the determined gamut range is within the gamut of the determined display unit 110.

For example, if the color gamut range supported by the display panel for red is 0 to 100 and the color gamut range for the red of the image signal is 10 to 90, the processor 120 may control the display unit 110 to display the image signal in the gamut range for red of the display unit 110. Although only the adjustment operation of the color gamut range for red has been described for the sake of convenience of description, the adjustment operation as described above can be performed for all R, G, and B colors at the time of implementation.

As described above, the display device 100 according to the present embodiment can change the gamut range of the display unit 110 by adjusting the size of the driving current applied to the display unit 110 according to the color distribution analysis of the image signal, and may provide optimal image quality by types of image signal.

Figure 2:
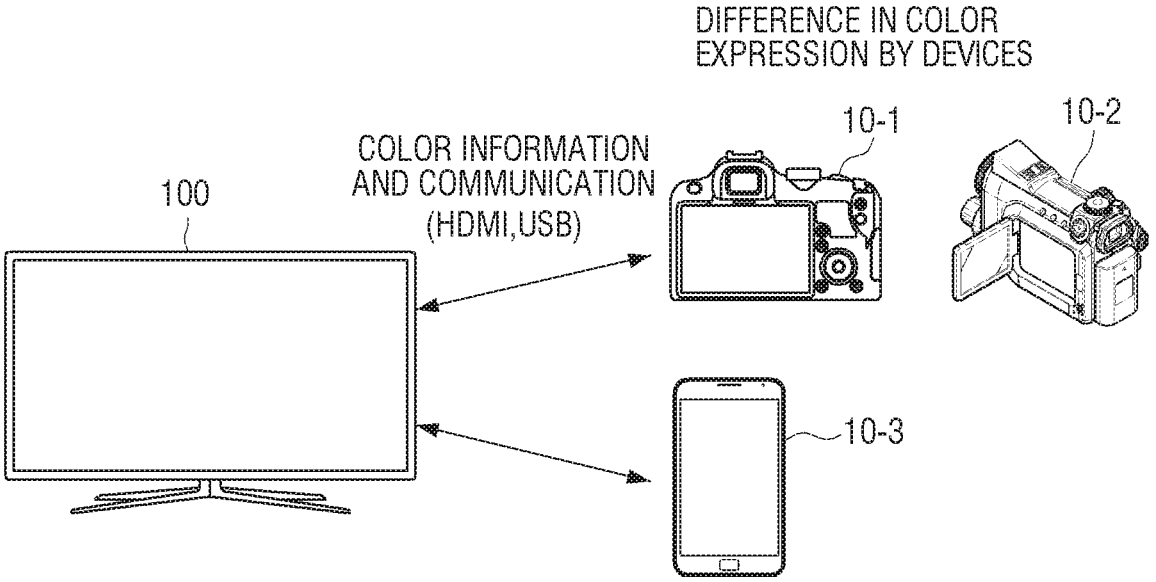
FIG. 2 is a view to describe an operation of a display device according to an exemplary embodiment.

FIG. 2 is a view to describe an operation of a display device according to an exemplary embodiment.

Referring to FIG. 2, the display device 100 is connectable to various external devices 10-1, 10-2, and 10-3. Here, the external devices 10-1, 10-2, and 10-3 can provide the display device 100 with image signals stored or generated according to different color standards. Accordingly, the gamut ranges of the image signals provided to the external devices may be different.

Therefore, the display device 100 according to the present embodiment may receive information of the corresponding device from the connected external devices 10-1, 10-2, and 10-3, or based on the format name or color standard information of the image signal, determine the gamut range of the transmitted image signal.

Then, the gamut range of the display device 100 may be adjusted according to the determined gamut range, and the input image signal may be displayed according to the gamut range of the adjusted display device 100.

Accordingly, the display device 100 can display an image in a gamut range optimized for the input image signal.

Figure 3:
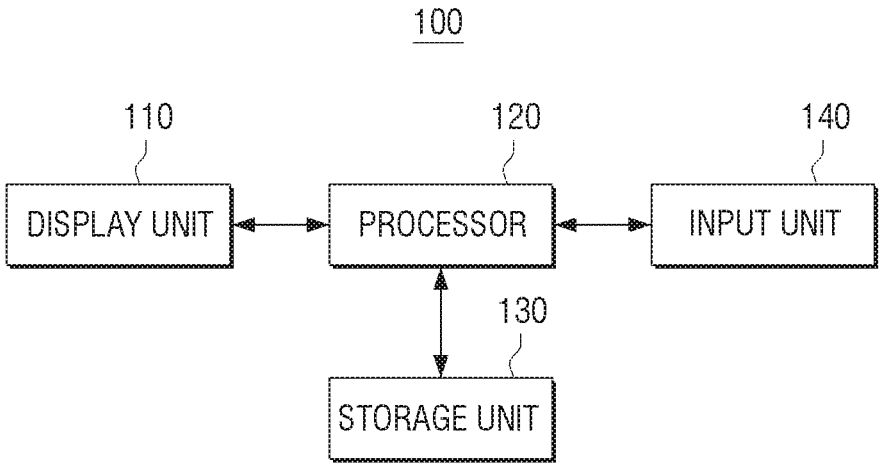
FIG. 3 is a block diagram illustrating a detailed configuration of a display device according to an exemplary embodiment.

FIG. 3 is a block diagram illustrating a detailed configuration of a display device according to an exemplary embodiment.

Referring to FIG. 3, the display device 100 may include the display unit 110, the processor 120, the storage 130, and the inputter 140.

The display unit 110 of the display device 100 according to the exemplary embodiment is the same as the configuration of FIG. 1, further description will be omitted.

The storage unit 130 may store information on the sizes of a plurality of drive currents that can be applied to the display unit 110. Also, the storage unit 130 may store information on the gamut range of the display unit 110 corresponding to the sizes of the plurality of driving currents. Here, information on the size of the driving current and the gamut range of the display unit 110 corresponding to the size of the driving current may be stored as a lookup table.

Meanwhile, the storage unit 130 includes information on luminance values of the display unit 110, and can store information on the sizes of the plurality of driving currents for realizing the luminance values and the driving time of the corresponding currents. Here, the luminance value of the display unit 110 may be a value set at the time of manufacturing the display device 100, or may be a value set by a user's input. At this time, information on the driving current corresponding to the gamut range, the target luminance value of the display unit 110, and the current driving time corresponding thereto can be stored as a lookup table.

In order to analyze the color distribution of the image signal, the storage unit 130 may store information on a plurality of regions that divide the vicinity of the gamut range of the image signal, and information on the predetermined threshold. Specifically, the storage unit 130 may store a threshold that sets a ratio of all pixels included in at least one of the plurality of regions to all pixels. At this time, the predetermined threshold value may be a default value set at the time of manufacturing the display device 100, or may be a value set by a user's input.

Then, the storage unit 130 may store information on the determined gamut range of the image signal, information on the gamut range of the display unit 110 which is determined based on the gamut range of the image signal, and the information on the gamut range of the display unit 110 which is adjusted according to color distribution analysis of the image signal.

The input unit 140 includes a plurality of function keys for user setting or selecting various functions supported by the display device 100. In addition, the input unit 140 can adjust the gamut range set in the display device 100. That is, the input unit 140 may receive the target gamut range and target luminance to be applied to the currently inputted image signal. Although the display unit 110 and the input unit 140 are illustrated as being separate components in the present embodiment, the present disclosure can be implemented as an apparatus that simultaneously realizes input and output such as a touch pad.

Meanwhile, the processor 120 may determine that the gamut range having the largest area overlapping the gamut of the image signal determined among the plurality of gamut ranges stored in the storage unit 130 as the gamut of the display unit 110.

The processor 120 may adjust the application time of the driving current based on the size of the driving current corresponding to the gamut of the display unit 110 stored in the storage unit 130 and the luminance value of the display unit 110. Therefore, even if the size of the driving current applied to the display unit 110 changes, the target luminance value of the display unit 110 can be maintained.

The processor 120 analyzes the color distribution of the image signal, and if the colors distributed in the plurality of regions dividing the gamut range of the image signal are equal to or greater than a predetermined value stored in the storage unit 130, may adjust the gamut range of the display unit 110. Specifically, the processor 120 may adjust the gamut range of the display unit 110 in units of frames or pixels of the image signal.

As a result of analyzing the color distribution of the next frame of the frame in which the gamut range of the display unit 110 is adjusted, if the color which is distributed to a plurality of regions that divides the gamut range of the image signal is less than the prestored value stored in the storage unit 130, the processor 120 may readjust the gamut range of the display unit 110 so that the gamut range returns to the gamut range prior to the adjustment.

Meanwhile, the processor 120 may determine that the target gamut range input from the user through the input unit 140 is the gamut of the image signal. This allows the user to directly adjust the gamut of the display unit, not to adjust the RGB values, and thus, the user convenience can be improved.

Meanwhile, although not illustrated, a communication unit for communication with an external device may be further included. At this time, the processor 120 may receive an image signal from an external device, display the signal in the gamut range of the display unit 110 adjusted as described above, and transmit the image signal of which gamut range is adjusted to the external device.

Figure 4:
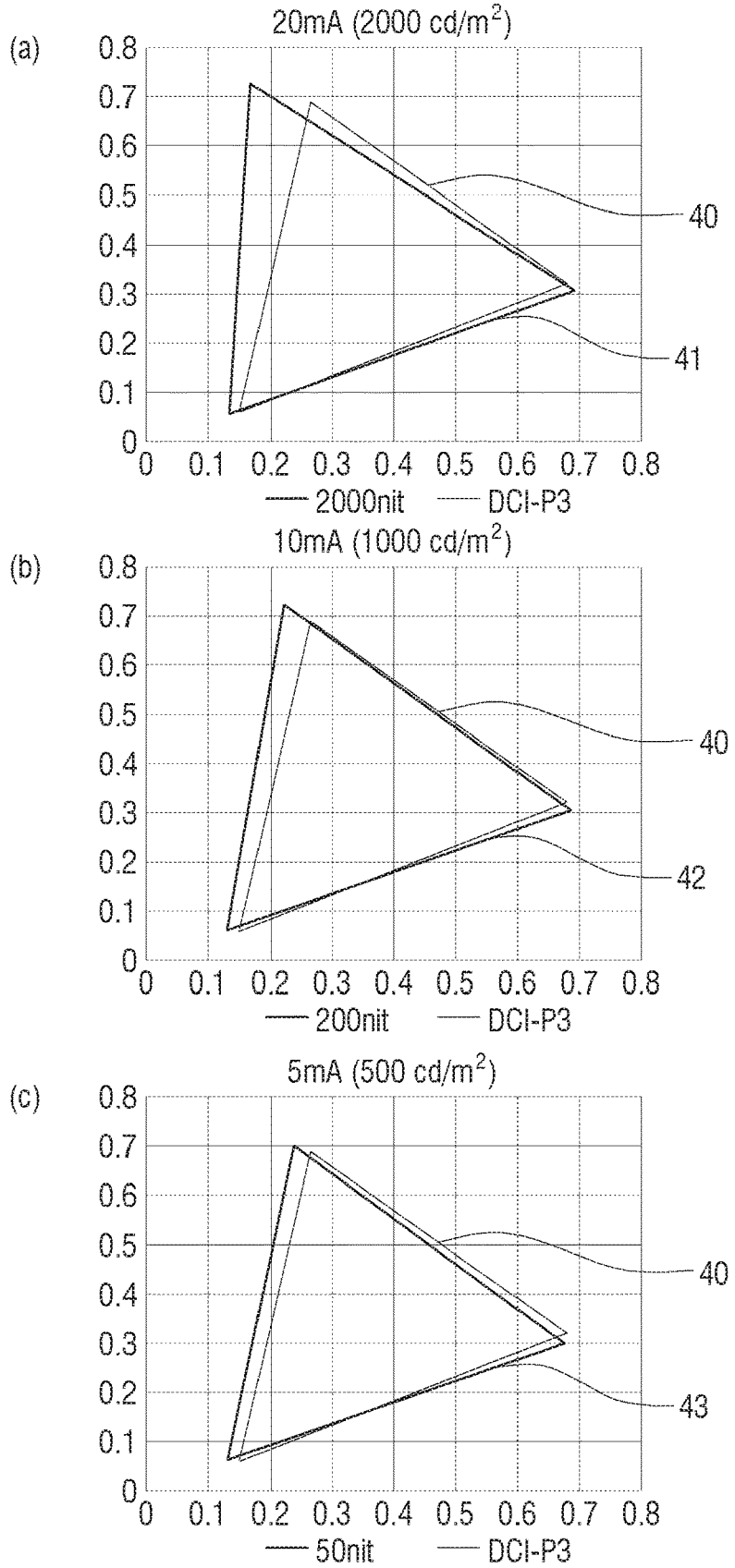
FIG. 4 is a view to describe a gamut range according to current applied to the display unit of FIG. 1.

FIG. 4 is a view to describe a gamut range according to current applied to the display unit of FIG. 1.

Referring to FIGS. 4 (*a*) to 4 (*c*), it can be seen that the gamut range of the display device is adjusted according to the size of the current applied to the display device, and the luminance value is changed.

Referring to FIG. 4 (*a*), when the driving current applied to the display device is 20 mA, the luminance of the display device is 2000 cd/m$^2$ (nit), and the gamut range 41 of the display device is significantly inclined to left side compared to the gamut range 40 of the image signal and thus, the color contained in the upper right region of the gamut range 40 of the image signal cannot be displayed. At this time, the gamut range 40 of the image signal may be DCI-P3, which is a standard gamut range.

Referring to FIG. 4 (*b*), when the driving current applied to the display device is 10 mA, the luminance of the display device is 1000 cd/m$^2$ (nit), and the gamut range 42 of the display device may be located on the right side compared to the gamut range of the display device shown in FIG. 4(*a*) and thus, the gamut range 40 of the image signal can be mostly included.

Referring to FIG. 4(*c*), when the size of the driving current applied to the display device is 5 mA, the luminance of the display device is 500 cd/m$^2$ (nit), and the gamut range 43 of the display device may not display color included in the right region of the gamut range 40 of the image signal.

Accordingly, the display device may determine the gamut range as in FIG. 4(*b*) which mostly includes the gamut range of the image signal, that is, which has the largest overlapped area of the gamut range of the display device according to the size of driving current and the gamut range of the image signal as the gamut range of the display device, and apply the corresponding driving current 10 mA to the display unit. As such, by adjusting the size of the driving current and determining the gamut range of the optimized display device, the degree of adjustment of the gamut range of the display device can be minimized. By this, the image signal can be displayed more correctly.

Figure 5:
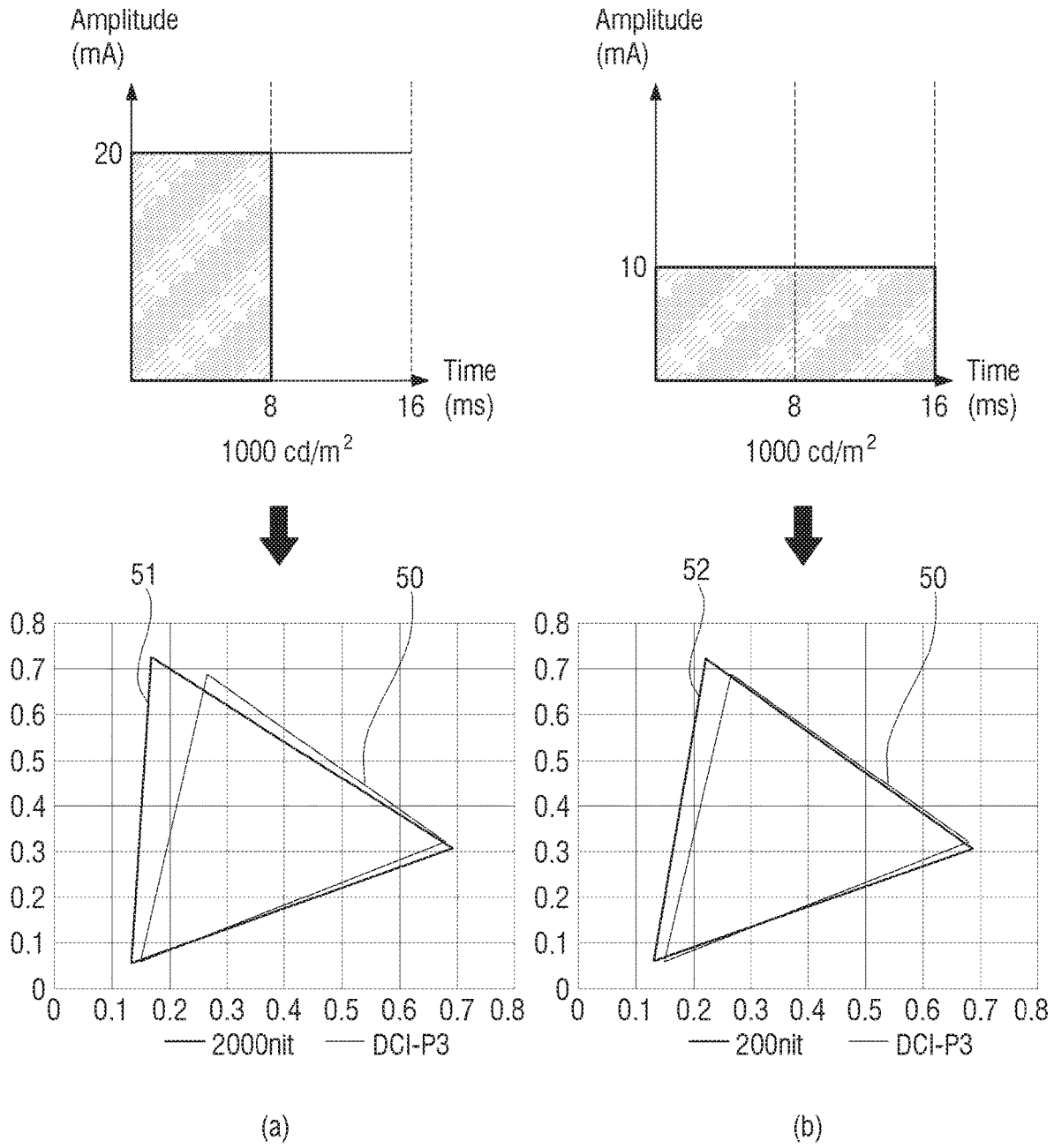
FIG. 5 is a view to describe a luminance adjusting method according to current applied to the display unit of FIG. 1, FIGS. 6 and 7 are views to describe an operation to adjust a gamut range of the display unit according to color distribution of a frame.

FIG. 5 is a view to describe a luminance adjusting method according to current applied to the display unit of FIG. 1.

Referring to FIGS. 5(*a*) and 5 (*b*), it can be seen that the luminance of the display device is 1000 cd/m$^2$. The LED device is controlled by the constant current control, and the brightness is proportional to the applied current. At this time, the luminance corresponding to the brightness is determined by multiplying the size of the driving current with the driving time. Thus, when the sizes of the applied driving currents are different, the display device can adjust the driving time of the current to equalize the luminance.

Specifically, referring to FIG. 5(*a*), the gamut range 51 of the display device when a driving current of 20 mA is applied to the display portion is shown. Referring to FIG. 5(*b*), a gamut range 52 of the display device when the driving current in size of 10 mA is applied is shown.

Here, the display device can determine the gamut range 52 shown in FIG. 5 (*b*) where the area overlapping the gamut range 50 of the image signal is larger as the gamut range of the display device as the gamut range of the display device. The driving current in size of 10 mA of the display device may be applied to the display to display an image signal. In the meantime, in order to realize the target luminance, the display device can apply a current of 10 mA in size to the display section for a current drive time (16 ms) which is twice that of the current drive time (8 ms).

As such, by adjusting the current driving time according to the size of the driving current, the display device can display the image signal with the adjusted gamut range and luminance.

Figure 6:
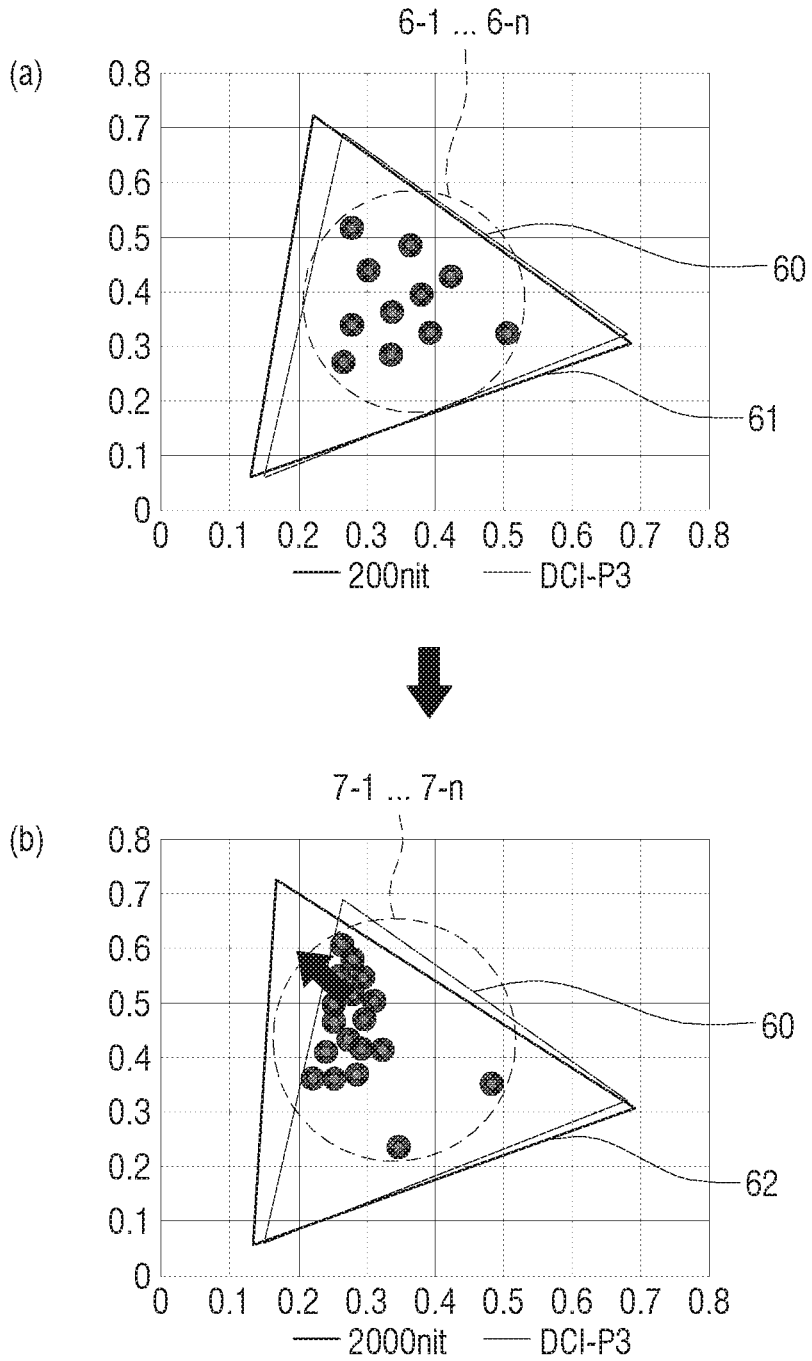

FIG. 6 is a view to describe an operation to adjust a gamut range of the display unit according to color distribution of a frame.

FIG. 6(*a*) shows the gamut range 60 of the image signal and the gamut range 61 of the display device. The result of analyzing the color distribution of the image signal on a frame-by-frame basis (6-1 . . . **6-*n*) is illustrated. Specifically, referring to FIG. 6**(*a*), it can be seen that the color of the frame is distributed over the gamut range 60 of the image signal, which means that the frame includes various colors. As a result of analyzing the color distribution of the frame as described above, when the color is distributed below the predetermined value at the boundary of the gamut range of the image signal, the display device, as illustrated in FIG. 4, may control that the image signal is displayed with the gamut range of the display unit of which the overlapping region with the gamut range of the image signal is largest.

In the meantime, FIG. 6 (*b*) shows the color gamut range 60 of the image signal and the gamut range 61 of the display device. The result of analyzing the color distribution of the image signal on a frame basis (7-1, . . . , **7-*n*) is displayed. Referring to FIG. 6** (*b*), it can be seen that the color of the frame is concentrated on the upper left boundary of the gamut range 60 of the image signal, which indicates that the frame contains a large number of similar colors. Here, if the color distribution of the frame is distributed over a predetermined value at the border of the gamut of the image signal as a result of analyzing the color distribution of the frame, the display device can adjust the gamut of the display device to extend in the boundary direction. Thus, by adjusting the gamut range of the display device, the color of the image signal can be expressed more deeply. That is, the color of the image signal can be displayed more abundantly and displayed.

Although the above description has been given only to the adjustment of the gamut range of the display device according to the analysis of the color distribution of the frame, in actual implementation, it can be implemented that the gamut range of the image signal is adjusted according to the color distribution analysis of the frame.

Figure 7:
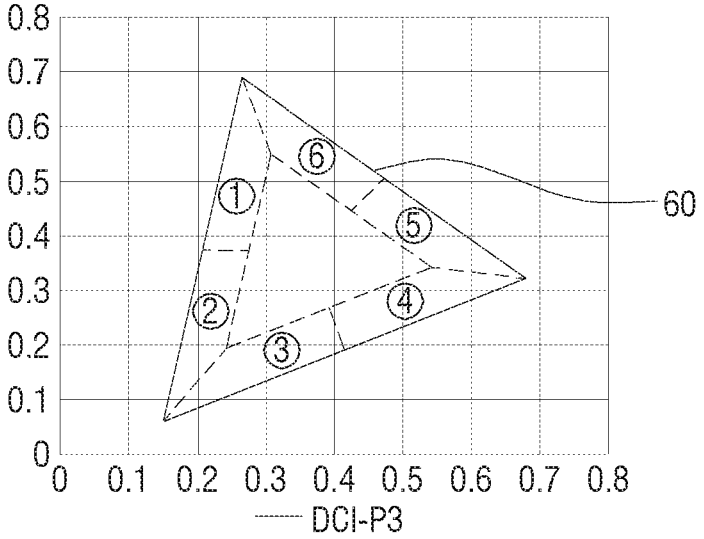

FIG. 7 is a view to describe an operation to adjust a gamut range of the display unit according to color distribution of a frame.

Referring to FIG. 7, the display device can divide the vicinity of the boundary of the gamut range 60 of the image signal into a plurality of regions. Specifically, the display device can divide the boundary of the gamut range 60 of the image signal into six regions. In this case, the display device analyzes the color distribution of the frame of the image signal. If the number of pixels having the color of the divided region has a ratio greater than a predetermined threshold value to the total number of pixels of the frame, the gamut range of the display device can be adjusted so as to extend the gamut range of the display device determined based on the gamut range to the corresponding region direction.

In this case, the threshold value used as a reference for adjusting the gamut range of the display device may be set to a different value for each region. In actual implementation, the number of regions dividing the boundary may be five or less, seven or more, and the range of the vicinity can be adjusted.

At this time, the display device can adjust the degree of adjustment of the gamut of the display device according to the ratio of the number of pixels having the color of the divided region to the total number of pixels of the frame.

In the meantime, the display device can adjust the gamut range using a lookup table storing information on a threshold value, a degree of adjustment of the gamut range of the display device, and a direction as a reference for adjusting the gamut range. Thus, by adjusting the gamut range of the display device, the color of the image signal can be expressed more deeply. That is, the color of the image signal can be displayed more abundantly and displayed.

Figure 8:
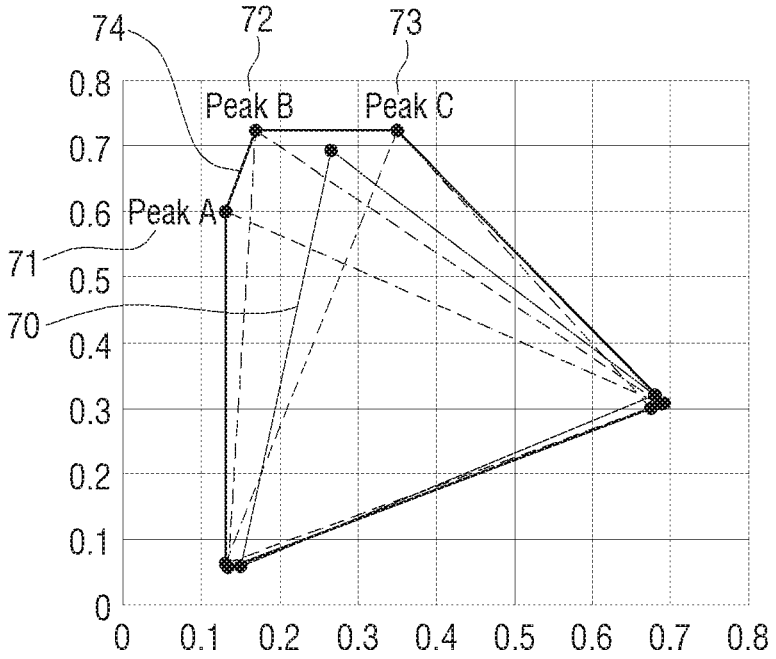
FIG. 8 is a view to describe an operation to adjust a gamut range by pixels according to an exemplary embodiment.

FIG. 8 is a view to describe an operation to adjust a gamut range by pixels according to an exemplary embodiment.

Referring to FIG. 8, the display device can adjust the gamut range of the display device on a pixel-by-pixel basis. Specifically, the display device may control the size of the applied driving current in units of pixels to adjust the gamut range of the display device on a pixel-by-pixel basis. For example, a pixel A applies a driving current of 10 mA to display an image signal in a gamut range 71 of peak A, and a pixel B applies a driving current of 5 mA to apply an image signal, and the pixel C can display the image signal in the gamut range 73 of peak C by applying a drive current of 2 mA. In this case, the driving time of the current may be differently implemented as 50 ms for the pixel A, 100 ms for the pixel B, and 250 ms for the pixel C in order to make the luminance constant.

As such, by controlling the size of the driving current and the current driving time for each pixel of the display and displaying the image signal in a different display gamut range for each pixel, the display device may display various colors of the image signal more correctly as the gamut range 74 of the display which includes all the gamut range of pixel A, pixel B, and pixel C.

Figure 9:
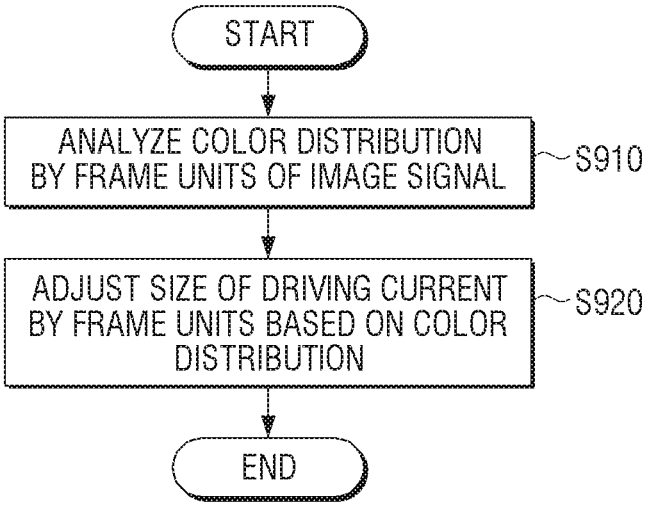
FIG. 9 is a flowchart to describe a method for adjusting a gamut range of the display unit according to an exemplary embodiment.

FIG. 9 is a flowchart to describe a method for adjusting a gamut range of the display unit according to an exemplary embodiment.

Referring to FIG. 9, the display device may analyze a color distribution of each frame unit of an image signal (S910). Specifically, the display device can analyze whether the color of the frame is distributed over a predetermined value at the boundary of the gamut range of the image signal.

Then, the display device can adjust the size of the driving current based on the color distribution on a frame-by-frame basis (S920). Specifically, when the color of the frame is distributed over a predetermined range on the boundary of the gamut of the image signal, the display device can adjust the size of the driving current applied to the display unit to be expanded in the boundary direction.

In the meantime, if the color distribution of the next frame of the frame in which the gamut range of the display unit is adjusted is analyzed, if the color distribution in a plurality of regions dividing the gamut range of the image signal is less than a preset value, the gamut range of the display portion can be readjusted to return to the previous gamut range. By adjusting the size of the driving current applied to the display unit, the gamut range of the display unit is adjusted and the gamut of the display unit is adjusted so that the color is expanded in the boundary direction in which the color is concentrated, so that the image signal is displayed in a richer color. In contrast, the adjustment of the gamut range of the display unit according to the color distribution is described in the description of FIG. 6 and FIG. 7, and the same description is omitted.

Figure 10:
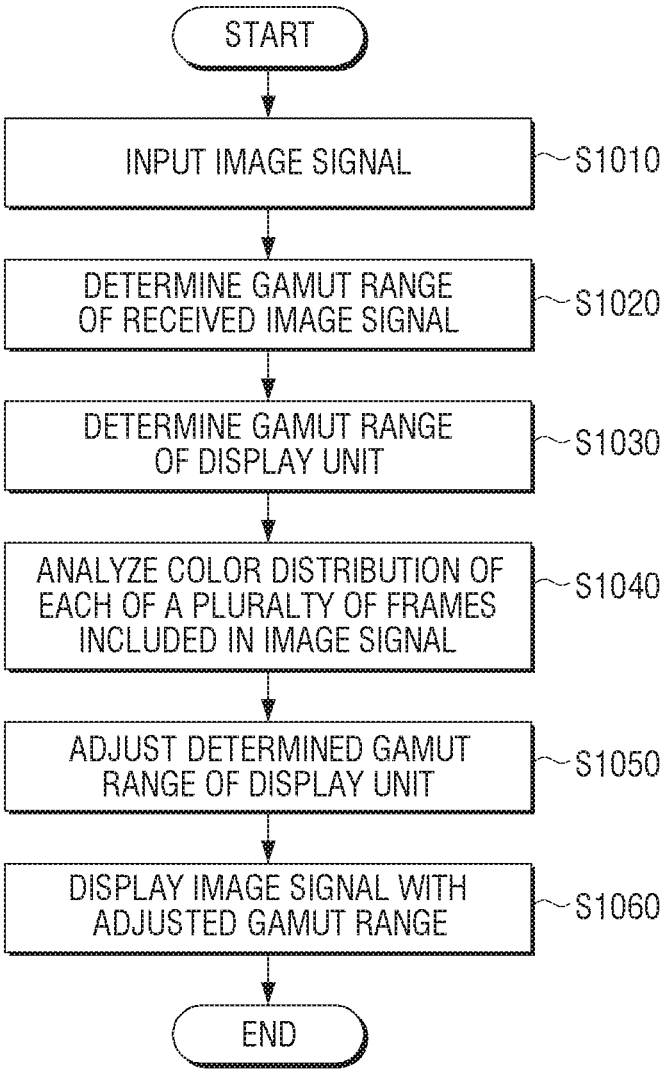
FIG. 10 is a flowchart to illustrate a method for displaying an image signal with the adjusted gamut range of the display unit according to an exemplary embodiment.

FIG. 10 is a flowchart to illustrate a method for displaying an image signal with the adjusted gamut range of the display unit according to an exemplary embodiment.

Referring to FIG. 10, the display device receives an image signal first (S1010). Specifically, the display device may receive an image signal from an external device, or receive an image signal stored in the display device.

Next, the display device can determine the gamut range of the input image signal (S1020). Specifically, the display device can determine the gamut range of the image signal based on the format name of the image signal, the color standard information of the image signal, and the like. Then, the display device may determine the gamut range based on the device information of the device providing the image signal.

Then, the display device can determine the gamut range of the display portion (S1030). To be specific, the display device may determine a gamut range of the display based on the determined gamut range of the image signal. Here, the display device may determine the gamut range of which the overlapping area with the gamut range of the determined image signal is widest, from among a plurality of gamut ranges corresponding to the size of the plurality of driving currents that can be applied to the display unit, as the gamut range of the display unit. At this time, the display device may adjust driving time of current according to size of driving current corresponding to the gamut range of the determined display and target luminance. This has been described in FIGS. 4 and 5 and will not be further described.

Next, the display device can analyze the color distribution of each of a plurality of frames included in the input image signal (S1040). Then, the display device can adjust the gamut range of the determined display unit (S1050). Specifically, the display device analyzes the image signal frame by frame to divide the vicinity of the boundary of the gamut range of the image signal into a plurality of regions, and when the ratio of the number of pixels included in at least one of the plurality of regions to the total number of pixels is more than the set value, the gamut range of the display unit can be adjusted so as to extend in the direction of the region where the ratio is equal to or larger than the predetermined value. The description thereof is given in the description of FIG. 6 and FIG. 7, and the same description is omitted.

In the meantime, the display device can adjust the gamut range of the display unit by adjusting the size of the driving current in units of pixels. Specifically, the display device may control the size of the driving current and the current driving time for each pixel to display the image signal in the gamut range of the different display portion for each pixel. This is described in detail with reference to FIG. 8, and the same description is omitted.

Then, the display device may display an image signal with the adjusted gamut range of the display unit (S1060).

As described above, according to various embodiments of the present disclosure, the gamut range of the display unit is adjusted by adjusting the driving current applied to the display unit in frame unit of the image signal and pixel unit of the display unit, and optimal image quality can be provided by image signal types.

The methods according to the exemplary embodiments of the present disclosure may be implemented in the form of program instructions that may be executed through various computer means and recorded on a computer readable medium. The computer-readable medium may include program instructions, data files, data structures, and the like, alone or in combination. For example, the computer-readable medium may be volatile or non-volatile storage such as a storage device such as ROM, whether or not erasable or rewritable, or a computer readable medium such as, for example, a RAM, memory chip, Memory, or a storage medium readable by a machine (e.g., a computer) as well as being optically or magnetically recordable, such as, for example, a CD, DVD, magnetic disk or magnetic tape. The memory that may be included in the mobile terminal is an example of a machine-readable storage medium suitable for storing programs or programs containing instructions embodying the embodiments of the present disclosure. The program instructions recorded on the medium may be those specially designed and constructed for this disclosure or may be available to those skilled in the art of computer software.

Although the present disclosure has been described with reference to certain exemplary embodiments and drawings, it is to be understood that the present disclosure is not limited to the exemplary embodiments described above, and that those skilled in the art can do various modifications and variations from such description.

Therefore, the scope of the present disclosure should not be limited to the exemplary embodiments described, but should be determined by the claims appended hereto, as well as the appended claims.

What is claimed is:

1. A display device comprising:

a display of which a gamut range is changed according to a size of a driving current;

a memory configured to store information on a plurality of gamut ranges; and a processor configured to:

identify a color distribution by frame units of an image signal, determine a gamut range of which an area overlapping with the color distribution by frame units of the image signal is largest, from among the plurality of gamut ranges stored in the memory, as a gamut range of the display, adjust the determined gamut range of the display by frame units based on the identified color distribution, and adjust a size of the driving current by frame units so that the display operates with the gamut range of the display.

2. The display device of claim 1, wherein the processor is further configured to:

determine a gamut range of the image signal based on a type of the image signal, and determine a gamut range of the display based on the determined gamut range of the image signal.

3. The display device of claim 2, wherein the processor is further configured to:

divide a vicinity of the determined gamut range of the image signal into a plurality of regions, and if a ratio of a number of pixels included in at least one of the plurality of regions to an entire number of pixels of a frame is greater than or equal to a predetermined value, adjust the determined gamut range of the display to a direction of at least one region.

4. The display device of 1, wherein the memory is further configured to store information on sizes of a plurality of driving currents and the information on the plurality of gamut ranges respectively corresponding to sizes of the plurality of driving currents.

5. The display device of 1, further comprising:

an input interface configured to receive a target gamut range by a user, wherein the processor is further configured to determine the target gamut range received from the user as a gamut range of the image signal.

6. The display device of 1, wherein the processor is further configured to, if there is a region in which a gamut range of the image signal is not included in the adjusted gamut range of the display, control the display so that a color of the region not included in the adjusted gamut range is displayed to be a color at a point in which a virtual line connected to a triple point of a gamut of the image signal intersects with a boundary of the adjusted gamut range of the display.

7. The display device of claim 1, wherein the display displays the image signal with a gamut range which is adjusted by the frame units.

8. The display device of claim 1, wherein the display adjusts a size of driving current by pixels of the display.

9. The display device of claim 1, wherein the processor is further configured to adjust an application time of the driving current, based on a target luminance and the adjusted size of driving current by the frame units.

10. The display device of claim 1, wherein the display comprises a display panel composed of light emitting diodes (LEDs).

11. A controlling method of a display device, the method comprising:

storing information on a plurality of gamut ranges;

identifying a color distribution by frame units of an image signal;

determining a gamut range of which an area overlapping with the color distribution by frame units of the image signal is largest, from among the plurality of gamut ranges stored in a storage, as a gamut range of a display;

adjusting the determined gamut range of the display by frame units based on the identified color distribution; and adjusting a size of a driving current by frame units so that the display operates with the gamut range of the display.

12. The method of claim 11, further comprising:

determining a gamut range of the image signal based on a type of the image signal; and determining a gamut range of the display based on the determined gamut range of the image signal.

13. The method of claim 12, wherein the adjusting comprises:

dividing a vicinity of the determined gamut range of the image signal into a plurality of regions; and if a ratio of a number of pixels included in at least one of the plurality of regions to an entire number of pixels of a frame is greater than or equal to a predetermined value, adjusting the determined gamut range of the display to a direction of at least one region.

14. The method of claim 11, further comprising:

storing information on sizes of a plurality of driving currents and the information on the plurality of gamut ranges respectively corresponding to sizes of the plurality of driving currents.

15. The method of claim 11, wherein, if there is a region in which a gamut range of the image signal is not included in the adjusted gamut range of the display, displaying a color of the region not included in the adjusted gamut range to be a color at a point in which a virtual line connected to a triple point of a gamut of the image signal intersects with a boundary of the adjusted gamut range of the display.

* * * * *